US007823638B2

(12) United States Patent
Ellingsen

(10) Patent No.: US 7,823,638 B2
(45) Date of Patent: Nov. 2, 2010

(54) SOUND SOURCE FOR STIMULATION OF OIL RESERVOIRS

(75) Inventor: Olav Ellingsen, Florø (NO)

(73) Assignee: Carbon Oil ASA, Oslo (NO)

( * ) Notice: Subject to any disclaimer, the term of this patent is extended or adjusted under 35 U.S.C. 154(b) by 61 days.

(21) Appl. No.: 11/815,840

(22) PCT Filed: Feb. 8, 2006

(86) PCT No.: PCT/NO2006/000053

§ 371 (c)(1),
(2), (4) Date: Jul. 29, 2008

(87) PCT Pub. No.: WO2006/085773

PCT Pub. Date: Aug. 17, 2006

(65) Prior Publication Data

US 2009/0008082 A1 Jan. 8, 2009

(30) Foreign Application Priority Data

Feb. 11, 2005 (NO) ..... 20050763

(51) Int. Cl.
*E21B 28/00* (2006.01)

(52) U.S. Cl. ..... 166/177.2; 166/249

(58) Field of Classification Search ..... 166/249, 166/177.1, 177.2, 369
See application file for complete search history.

(56) References Cited

U.S. PATENT DOCUMENTS

| | | | | |
|---|---|---|---|---|
| 3,323,592 | A * | 6/1967 | Brandon | 166/249 |
| 3,520,362 | A | 7/1970 | Galle | |
| 4,417,621 | A | 11/1983 | Medlin et al. | |
| 5,031,717 | A | 7/1991 | Hardee et al. | |
| 5,836,389 | A * | 11/1998 | Wagner et al. | 166/249 |
| 6,186,228 | B1 | 2/2001 | Wegener et al. | |
| 6,250,386 | B1 | 6/2001 | Ellingsen | |
| 2003/0201101 | A1 * | 10/2003 | Kostrov et al. | 166/249 |
| 2009/0090503 | A1 * | 4/2009 | Groves | 166/249 |

* cited by examiner

*Primary Examiner*—Shane Bomar
(74) *Attorney, Agent, or Firm*—Volpe and Koenig, PC

(57) ABSTRACT

The present invention relates to a sound source for the stimulation of an oil reservoir or an oil well for enhanced oil recovery or for seismic logging of the reservoir. The sound source is operated by a pressurized gas from a compressor or a pressure tank on the surface, and the gas is transported to an in the sound source situated cylinder with an accumulator, via a feed line.

8 Claims, 5 Drawing Sheets

SOUND SOURCE FOR STIMULATION OF OIL RESERVOIRS

The present invention is an improvement of our Norwegian patent 175498 which is related to a process for stimulation of oil wells by utilization of sound waves which are transmitted by a hydraulic operated sound source or hammer. The present invention shows a different design of the sound source, which doubles the effect of the stimulation of an oil well.

Till now it has only been possible to recover a part of the oil in an oil reservoir because of the special bonding forces, which traps the oil in the formation. This is a combination of capillary, adhesive and hydraulic forces.

The major part of the oil will remain in the reservoir until new technologies make it possible to affect the bonding forces trapping the oil in the formation.

As the observed reserves in an oil reservoir represent substantial economical values it is of the greatest interest to find new methods and equipment in order to increase the yield from the reservoir.

The present invention shows a new tool for increased oil recovery and makes it possible to restart oil production from shut wells and in wells with declining oil production. This is obtained by sound waves where it has been found that the best effect is obtained when the sound waves are generated and transmitted into the oil bearing formation.

According to the invention, it is proposed a procedure by sound stimulation of oil wells wherein a vertical oscillating vibrator (hammer) which is driven by gas is inserted in an oil well, where compressed gas is charged to the tool from a compressor or a battery of gas bottles under pressure and where the exhaust of the gas is routed down and around the plunger and out into the annulus between the production string and the casing. The tool generates elastic sound waves when the plunger hit one or several expansion element(s) and transmit elastic sound waves into the reservoir for some few to several hundreds blows per minute and where the frequencies in the wave trains are characterized by the impact of the plunger which is found to be approx. 1000 Hz down to some few Hz.

Worldwide research takes place in an effort to find new methods to increase the oil production in so-called secondary recovery. Such methods include injection of chemicals, electrical stimulation, electro magnetic stimulation and also methods for acoustic stimulation. The interest is in particular focused around the conditions related to surface tension and interphase tension between oil and water and where it has been tried to solve the problem by injecting tensides and surfactants which break the tensions.

The present invention can be used together with such methods and also together with electrical and electromechanical stimulation as described in Norwegian patent 161,697 and U.S. Pat. No. 5,282,508.

The following is relevant as to how the sound waves affect the oil production and what laboratory tests and three-dimensional simulation of an oil reservoir have shown.

The drive mechanisms in a reservoir can be:

1. Fluid- and matrix expansion.
2. Water drive.
3. Gas top drive.
4. Dissolved gas drive.

The invention can be used in connection with all these mechanisms.

In connection with dissolved gas in the oil, the gas will expand as small droplets when the pressure drops or when the reservoir is heated and the pressure are below the critical pressure of the gas.

The gas bubbles will displace the oil so that the oil will flow in the reservoir in the direction of the pressure drop.

The oil droplets are often surrounded by water and there are very few particles, which can cause growth for the bubbles. In such a case one will experience "bubble point rise" in accordance with increased boiling point, and the pressure where the bubbles start to form will be substantially lower than what the temperature should indicate.

Thus the pressure has to be reduced in order to initiate growth of bubbles on the micro bubbles present in any liquid. It is found that sound vibrations affect the "bubble point rise" so that the boiling can start easier. The interphase tension between oil and gas tend to prevent the flow in a reservoir. The interphase tension between oil and gas is relative and is further reduced by increasing pressure. It is therefore possible to obtain great effect even with weak vibrations.

Laboratory tests have shown that it is possible to restart the flow of oil in a rock matrix with vibrations as weak as 0.04 g. In this connection, 80% recovery of the trapped oil in the matrix has been achieved.

When the oil flow has stopped, an equilibrium is established which can be altered by weak sound stimulation.

As the sound waves propagate radially from the well and the oil flows towards the well, optimal effect will be obtained with a modest energy consumption.

It has further been shown that oil and other fluids flow easier in a porous medium when affected by vibrations.

This explains why even fluids, which can be looked upon as Newtonian fluids, behave like a thixotropic fluid in small droplets. In the border between the flowing liquid and the surrounding pores, the molecules will align as a consequence of greater or lower polarity.

Vibration of the fluid will cause micro capillary waves in the fluid which prevent the molecules from establishing polar couplings whereby the oil will flow easier.

The sound energy will be absorbed in the reservoir as heat, which in turn will increase the pressure due to partial evaporation and expansion, which in turn will give rise to increased oil recovery.

When water enters the production wells, one often faces the situation that large amount of oil is trapped in the reservoir because of capillary forces.

Intensive research has been carried out in order to develop tensides to reduce these capillary forces. Sound stimulation together with tensides will be advantageous as sound stimulation is very well suited in reducing the interphase tensions.

It has also been possible to recover water trapped oil, but then with stronger vibrations (5-10 g) and where the direction of the wave propagation has been the same as the flow direction of the oil.

U.S. Pat. No. 5,282,508, mentioned above describes a number of different vibrators for stimulation of an oil reservoir together with electrical stimulation. These vibrators are driven with electrical power, but operation of the vibrators with the hostile environment in an oil well give rise to major practical insulation problems as the voltages used was in the order of 1500 volt. Thus it has been necessary to develop a vibrator which is driven by an alternative energy source. The most logical solution would be to use hydraulic power, but because of the considerable distances down the well and the need for two lines (feed and exhaust), this causes great problems because of the pressure loss.

As described in our Norwegian patent 175498, even one pressure line will cause flow restriction to such a degree that the effect will be dramatically reduced.

The present invention shows a design where gas instead of hydraulic power is used to operate the hammer. The following conditions are needed in order to realize this situation: A compressor or a bottle battery of pressurized gas, which continuously feeds gas to the tool. As the tool not can be regulated from the surface, a piston needs to be connected to a plunger in the tool, which can be is lifted by the gas pressure. The space above the piston functions as an accumulator and where the gas in the accumulator, when compressed, acts as a spring which can accelerate the piston and the plunger downwards. This is achieved with a valve, which is activated when the piston and the plunger have reached their highest position. The valve is designed so that when it changes its position, the gas is drained between the plunger and its surrounding pipe. When the plunger hits the expansion elements, which are located in the pipe surrounding the plunger, the piston changes the position of the valve whereby the piston is lifted again. The number of blows is dependent upon the gas flow rate and the preset pressure in the accumulator gives the force, i.e. velocity of the plunger by impact. In our previous patent the plunger is surrounded by oil. Because of the velocity of the plunger, about 50% of the energy is lost in heat because of the friction between the oil and the plunger. As the plunger in the present invention is surrounded by gas this energy loss is avoided, whereby the present invention is 50% more effective than our previous invention.

DESCRIPTION OF THE FUNCTION OF THE TOOL

If the pressure is set to p1 bar, this is the pressure lifting the plunger and compressing the gas in the accumulator above the piston. The pressure in the accumulator and the earth's gravity acceleration gives the force accelerating the plunger downwards. The piston and the plunger are given an acceleration $a=F/G$ where G is the mass of the piston and the plunger in kg. The velocity of the plunger by impact is calculated by $v=(2gs)^{0.5}$ where s is the stroke length in meter. Travel time is given by $t=v/a$. At impact the piston and the plunger have accumulated the kinetic energy $E=Gv^2/2$ (Nm). The effect by impact is given by $P=E/\Delta t$ where $\Delta t$ is the impact time. Tests have shown that with moderate dimensions it is possible to accumulate approx. 3000 Nm with an impact time of 10 ms with an effect (power) of 300,000 W at the impact moment.

During tests we have found the following accelerations from the centre of a test well located on the surface, as shown in FIG. 5.

In addition to use the tool for enhanced oil recovery, it is also possible to use the tool as a continuous working seismic tool in order to map the flow of the fluids in the reservoir. This is of great importance in order to be able to plan the production from different wells in order to optimize the total production from the reservoir.

In our previous patent, the expansion element is made as a part of a slotted pipe where the plunger is running. Because of the fatigue stress in the pipe with this arrangement, it has been shown that this arrangement give too short lifetime to be applied in an oil well. The expansion elements will also cause a concentration of the impact force against the casing. This is not the case in the present design where the expansion elements are loose and can align themselves to the casing without any concentrated spots. The side of the expansion element facing the casing are parallel to this and with a circular shape for matching the inside diameter of the casing.

The expansions elements have a bevel cutting in each end facing the inside of the tool tubing. At the upper side of the expansion elements is located an anvil with a cone matching the bevel cutting. The top of the anvil which receives the impact of the plunger is almost flat.

At the opposite end of the expansions elements these are resting against an anvil which is welded to the pipe in which the plunger is running.

In addition to one set with expansions elements, it is possible to locate several set of expansions elements which are separated from each other by an anvil conical in each end but where the anvil receiving the stroke has a flat surface on the top.

To optimize the effect of the sound waves, the element sets can be rotated relative to each other such that all elements form a spiral path along the casing.

If for example one set consists of two expansion elements, the next set above this can be arranged with a displacement of 90 deg relative to the first set and so on. With this arrangement one obtains two wave trains with 90 deg. phase difference. When the wave trains meet, interference will occur where a wave top meets another wave top, resulting in increasing amplitude.

The invention is explained in detail referring to the enclosed drawings, wherein FIG. 1. shows the tool with all its components hanging in the end of the production string G) having an ordinary sucker rod pump pumping the oil to the surface. A) shows a cylinder housing the valve arrangement, piston and the accumulator and is connected at the upper side to an end piece to which the production string is connected and in the lower end to a piece containing the valve and to which the pipe C) is connected. In pipe C) runs the plunger B) which strike the anvil D). When it is pressed town, it will press the expansion elements E) against the casing C). In the lower end of the expansion elements, a counter anvil F) is arranged and connected to the pipe C).

Figure 1:
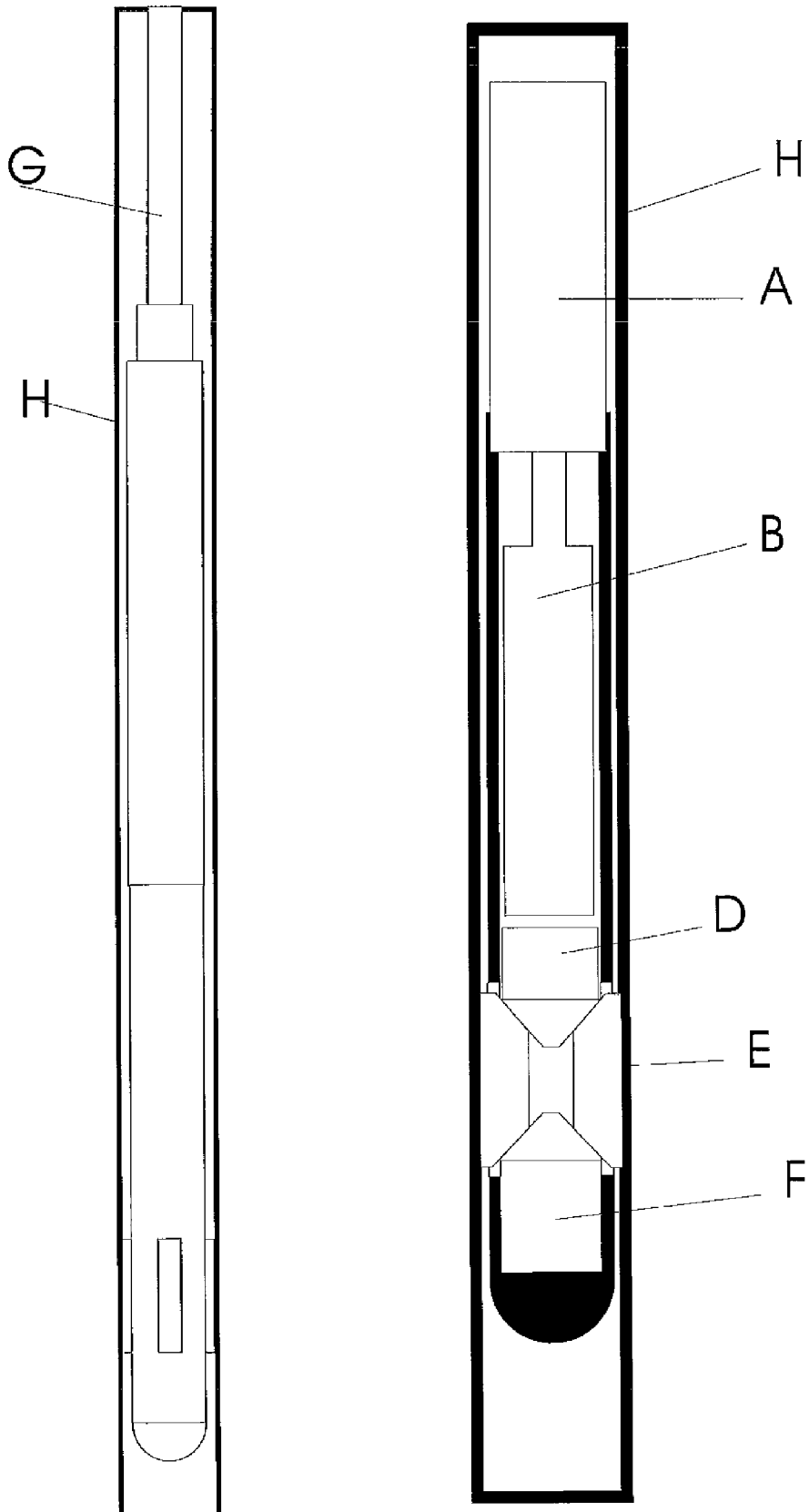
Figure 2:
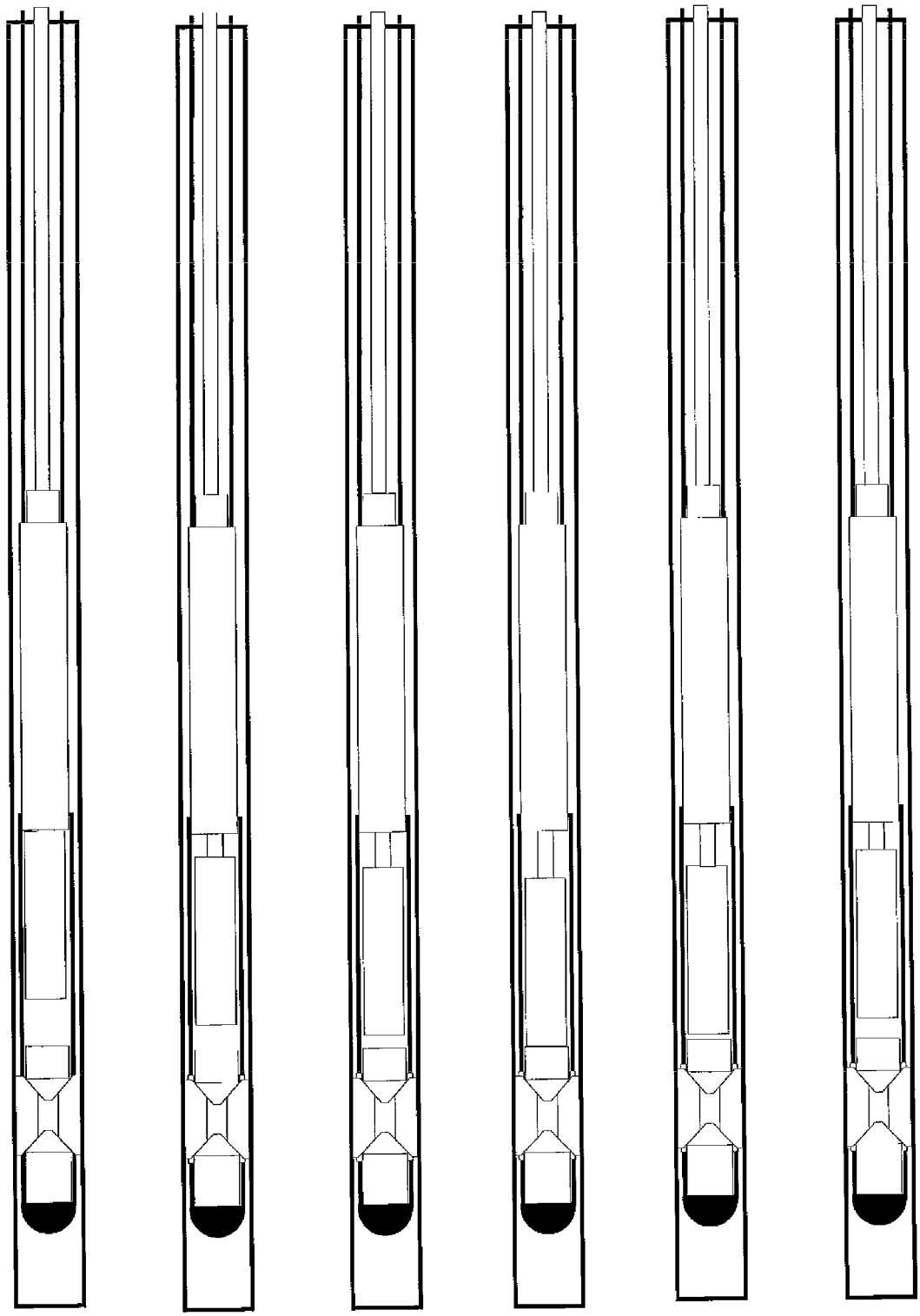
FIG. 2 shows the different phases of the tool in operation.
Figure 3:
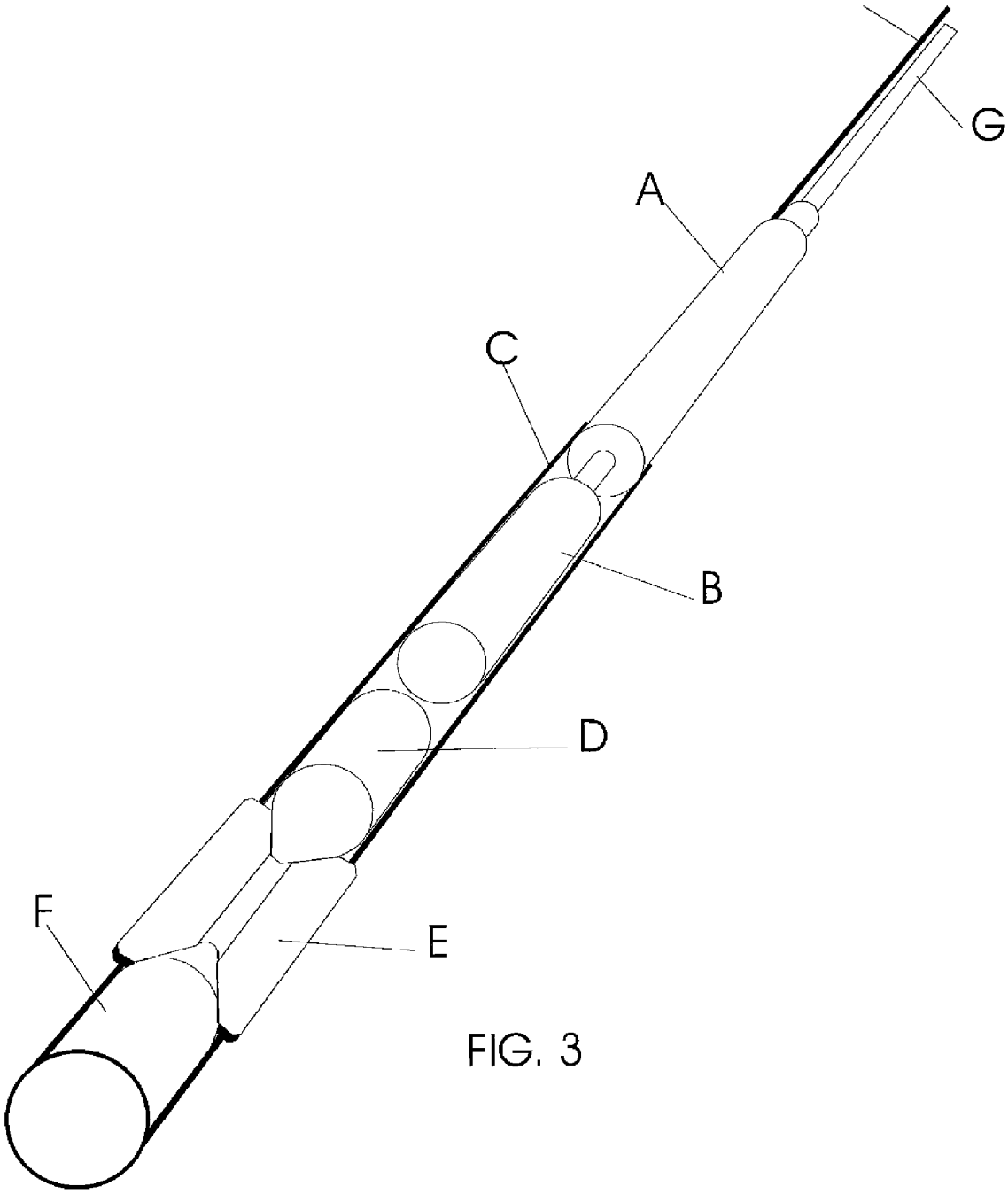
FIG. 3 shows a perspective of the tool with its different components.
Figure 4:
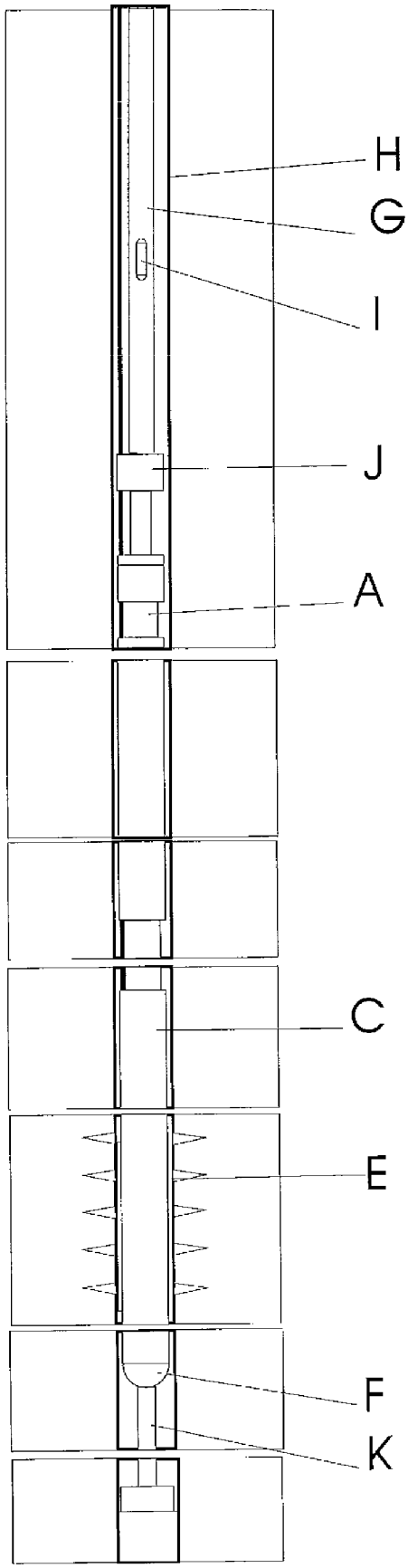

FIG. 4 shows the tool hanging in the production string G) which has an opening I) for oil into the sucker rod pump in the production string. J) shows a shock absorber which can be located between the tool and the production string in order to damp vibration into this. Furthermore, the tool can be supported in the bottom of a well with a rod K) resting against a support J) in the bottom of the well. This support can be made of steel or cast iron resting on a cement plug cast into the casing. If such arrangement is not used, the tool may hang in the production string.

Figure 5:
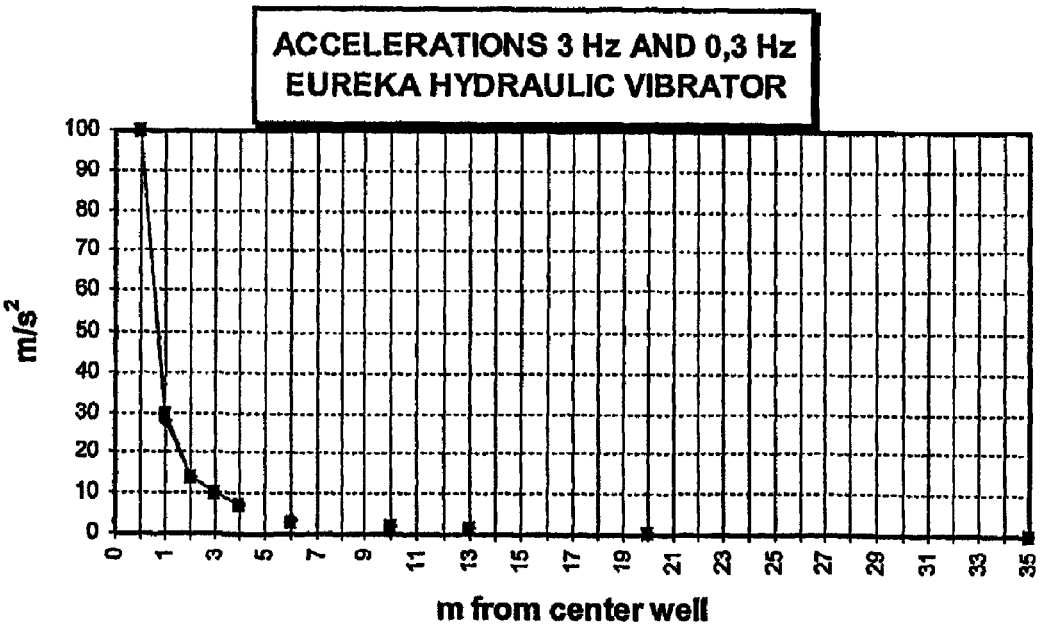

FIG. 5 shows distance from center well versus acceleration for the hydraulic vibrator.

The invention claimed is:

1. A sound source for the stimulation of an oil reservoir or an oil well for enhanced oil recovery, wherein the sound source is driven by a pressurized gas from a compressor or pressure tank at a surface and wherein the gas is injected via a hose or pipe into a cylinder containing a piston connected to a plunger, whereby loose and alignable expansion elements with openings for release of the gas are arranged in the cylinder surrounding the plunger, and whereby a space above the piston functions as an accumulator.

2. The sound source for the stimulation of an oil reservoir or an oil well for enhanced oil recovery according to claim 1, wherein, in the cylinder in the sound source, there is arranged a valve with a spool which, when the piston has reached its lowest point, pushes the spool in a position whereby the gas is injected below the piston and lifts the spool up until a plunger in the sound source pushes the spool in a position whereby the gas is exhausted around the plunger and pressure in the accumulator accelerates the piston and the plunger reaches its impact point whereby the process repeats.

3. The sound source for stimulation of an oil reservoir or an oil well for enhanced oil recovery according to claim 1, wherein the gas which is evacuated from around the plunger is exhausted between the plunger and the cylinder surrounding the plunger and then out of the sound source at openings for the expansion elements whereby the plunger is running in the gas.

4. The sound source for stimulation of an oil reservoir or an oil well for enhanced oil recovery according to claim 1, wherein the expansion elements hitting a casing in the oil well consist of several sets of expansion elements above each other separated by anvils which are conical in both ends, and wherein the expansion elements may be staggered relative to each other so that each set of elements are rotated an angle from each other.

5. The sound source for seismic mapping of an oil reservoir according to claim 4, wherein in a housing in the sound source, there is arranged a valve with a spool which, when a piston has reached its lowest point, pushes the spool in a position whereby the gas is injected below the piston and lifts the spool up until a plunger in the sound source pushes the spool in a position whereby the gas is exhausted around the plunger and the pressure in the accumulator accelerates the piston and the plunger reaches its impact point whereby the process repeats.

6. The sound source for seismic mapping of an oil reservoir according to claim 1, wherein the gas which is evacuated from around the plunger is exhausted between the plunger and the pipe surrounding the plunger and then out of the sound source at openings for the expansion elements whereby the plunger is running in the gas.

7. The sound source for seismic mapping of an oil reservoir according to claim 1, wherein the expansion elements hitting a casing in the oil well consist of several sets of expansion elements above each other separated by anvils which are conical in both ends, and wherein the expansion elements may be staggered relative to each other so that each set of elements are rotated an angle from each other.

8. A sound source for seismic mapping of an oil reservoir, wherein the sound source is driven by a pressurized gas from a compressor or pressure tank at a surface and wherein the gas is injected via a hose or pipe into a cylinder containing a piston connected to a plunger, whereby loose and alignable expansion elements with openings for release of the gas are arranged in the cylinder surrounding the plunger, and whereby a space above the piston functions as an accumulator.

* * * * *